US005197572A

United States Patent [19]

Roberts

[11] Patent Number: 5,197,572

[45] Date of Patent: Mar. 30, 1993

[54] IN-LINE SKATE BRAKE SYSTEM

[76] Inventor: Jeffrey A. Roberts, 12851 Floral Ave., Apple Valley, Minn. 55124

[21] Appl. No.: 756,155

[22] Filed: Sep. 6, 1991

Related U.S. Application Data

[63] Continuation-in-part of Ser. No. 691,450, Apr. 25, 1991.

[51] Int. Cl.[5] ..... A63C 17/14

[52] U.S. Cl. ..... 280/11.2; 188/5

[58] Field of Search ..... 188/5; 280/11.2

[56] References Cited

U.S. PATENT DOCUMENTS 2,485,147 10/1949 Fowlkes ..... 280/11.2

5,067,736 11/1991 Olson et al. ..... 280/11.2

*Primary Examiner*—Matthew C. Graham

*Attorney, Agent, or Firm*—Hugh D. Jaeger

[57] ABSTRACT

An in-line skate braking system for braking of an individual on in-line skates by transferring the center of gravity about the rear roller to frictionally engage a brake pad of one in-line skate or both in-line skates against the ground. The brake pad is of a suitable material, such as rubber, so as to frictionally engage with the ground surface. The degree of braking is determined by the degree of pressure axially transferred about the rear roller by the center of gravity to the brake pad. By the skater properly shifting his or her weight about the rear roller, maximum force can be applied between the brake pad to the ground surface, causing a safe stop over a finite distance. In a fourth embodiment, an after-market replacement brake assembly includes a cast member for engagement with a brake shoe of an in-line skate, and a rubber pad which screws onto the cast member.

2 Claims, 7 Drawing Sheets

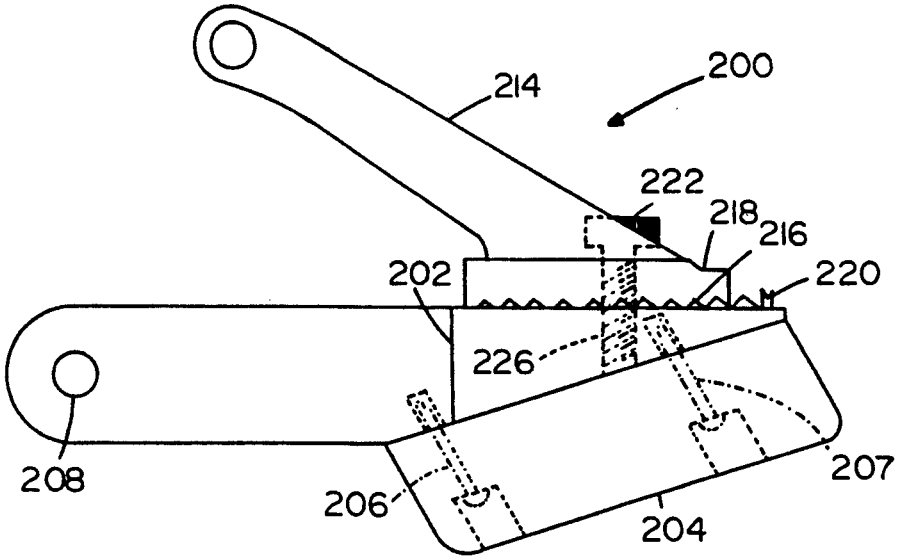
FIG. 7
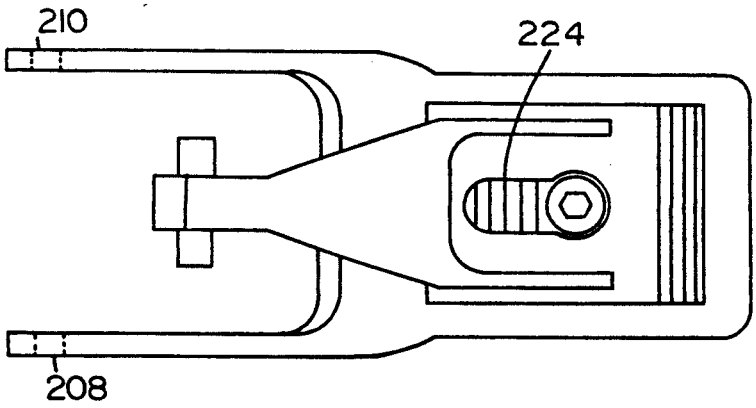
FIG. 8
FIG. 9
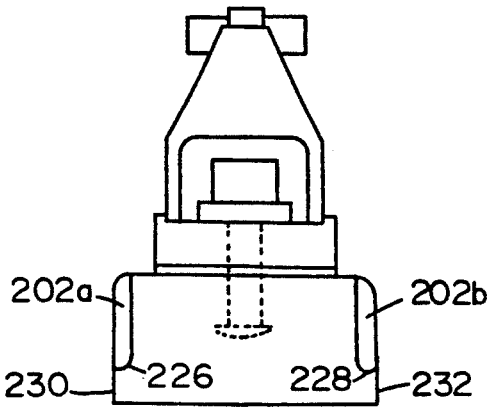

FIG. 14
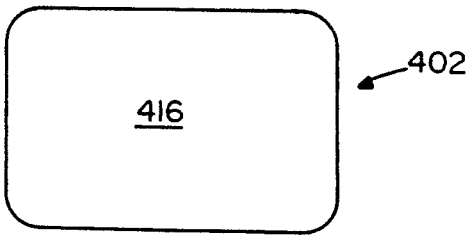
FIG. 13
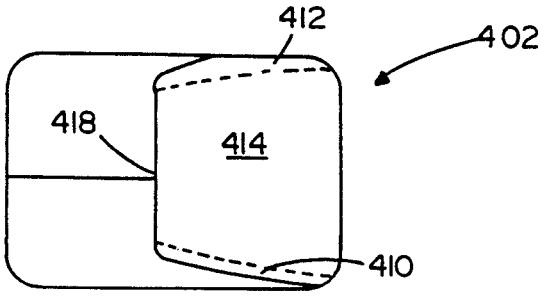
FIG. 15
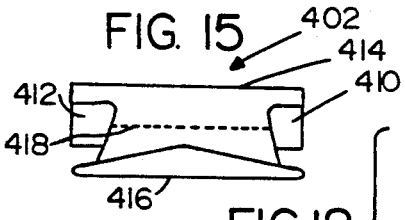
FIG. 12
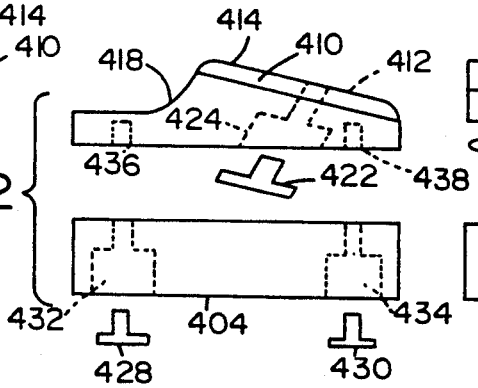
FIG. 16
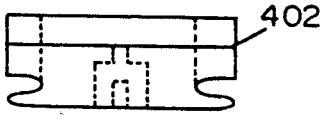
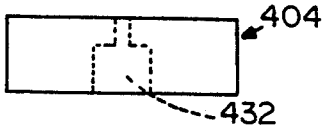
FIG. 18
FIG. 17
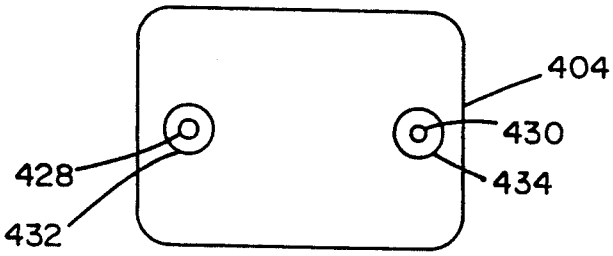

IN-LINE SKATE BRAKE SYSTEM

CROSS REFERENCES TO CO-PENDING APPLICATIONS

This application is a continuation-in-part of U.S. Ser. No. 07/691,450, filed Apr. 25, 1991, entitled "In-Line Skate Brake System" to the same applicant.

BACKGROUND OF THE INVENTION

1. Field of the Invention

The present invention pertains to an in-line skate, and more particularly, pertains to a brake system for affixing to the rear roller of an in-line skate. The brake system can be for new in-line skates, and can also be adapted as an after-market accessory for in-line skates. One embodiment of the brake includes a cast brake shoe and a replaceable brake pad.

2. Description of the Prior Art

In-line skating has become a popular exercise and popular sport worldwide. So far, in-line skates have not been provided with an effective braking system. In-line skaters sometime resort to the same type of action as ice skaters in stopping forward movement of the individual with the in-line skates. This is not always effective because individuals are not always able to stop their motion.

Prior art brakes for in-line skates have not included a easily replaceable rubber brake pad.

The present invention overcomes the disadvantages of the prior art by providing a braking system for an in-line skate.

SUMMARY OF THE INVENTION

The general purpose of the present invention is to provide a braking system for an in-line skate which can be easily utilized by any individual. One embodiment includes a cast brake shoe for the in-line skate and a easily replaceable rubber pad.

According to one embodiment of the present invention, there is provided an in-line skate, including a boot, opposing planar members with rollers therebetween, opposing brake supports affixed to the rear roller, a brake shoe affixed to the brake supports, and a soft, pliable brake pad affixed to the brake shoe. Any suitable brake pad can be utilized which will frictionally engage against the ground surface, and provide for adherence to the ground surface, as well as a braking action between the brake pad and the ground surface. Depending upon the ground surface, different types of brake pad materials can be utilized.

According to another embodiment of the present invention, there is provided a brake assembly, including a cast brake shoe and a easily replaceable rubber pad, which screws onto the cast brake shoe which can be inserted into an existing in-line skate brake assembly, such as that for a Rollerblade in-line skate. The old existing brake is removed from the brake assembly, and the new brake is slid into the brake assembly, screwed into position through a hole in the bottom of the cast member into a pre-existing hole of the brake assembly, and then the rubber replacement pad is screwed on through existing holes in the rubber pad and into the bottom of the cast brake shoe. Of course, the rear wheel and the brake assembly has to be removed from the in-line skate. The cast brake shoe and the rubber brake pad can be sold as after-market accessories or original equipment.

Significant aspects and features of the present invention include a braking system for an in-line skate which is effective for a braking action during movement by the individual on the in-line skates. The degree of braking action is determined by the pressure transferred about the rear roller against the ground surface. Pressure is transferred about the rear roller by the skater, essentially transferring the center of gravity about the rear roller by movement of the skater's body in a slightly backward direction.

Another significant aspect and feature of the present invention is a brake system for an in-line skate, which can be incorporated as an after-market product or on original equipment.

A further significant aspect and feature of the present invention is an in-line skate braking system which provides for easy replacement of the brake pads, which is desirable depending upon the particular type of ground surface, whether the ground surface be cement, asphalt, or indoor surfaces, such as running tracks, tile, etc.

A still additional significant aspect and feature of the present invention is an in-line skate brake which is easily utilizable by any individual, and provides for the upmost in safety. The rubber brake pad is easily replaceable, and only requires the mere use of a simple screw driver. Different degrees of hardness of rubber can be utilized depending upon the degree of desired braking, as well as the particular surface on which the braking is occurring.

Having thus described the embodiments of the present invention, it is the principal object hereof to provide a braking system for an in-line skate.

One object of the present invention is to provide a braking system for an in-line skate which provides for the stopping of an individual on in-line skates when in motion by transferring the individual's center of gravity about the rear roller to provide pressure on the brake pad against the ground surface.

Another object of the present invention is to provide a braking system for an in-line skate which is easy to utilize by any individual, and does not require but an average degree of athletic skill in the shifting of an individual's center of gravity about a pivot point, which is the rear roller, while still moving on the in-line skates.

A further object of the present invention is an adjustable angle for the brake pad providing maximum pad contact area, more wear compensation for each brake pad, and to accommodate different styles of skating from pleasure skating to track skating.

An additional object of the present invention is a brake with an easily replaceable brake with a cast brake shoe, and an easily replaceable brake pad, which can be sold as original equipment or an after-market accessory. Particular design is such as to fit into the popular models of in-line skates.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 7 illustrates a second alternative embodiment of an adjustable brake system for an in-line skate;

FIG. 8 illustrates a top view of FIG. 7;

FIG. 9 illustrates an end view of FIG. 7;

FIG. 12 illustrates an exploded view of the cast brake pad;

FIG. 13 illustrates a top view of the cast brake pad;

FIG. 14 illustrates a bottom view of the cast brake pad;

FIG. 15 illustrates a rear end view of the cast brake pad;

FIG. 16 illustrates a front end view of the cast brake pad;

FIG. 17 illustrates a bottom view of the replacement rubber pad; and,

FIG. 18 illustrates an end view of the replacement rubber brake pad.

DESCRIPTION OF THE PREFERRED EMBODIMENTS

Figure 1:
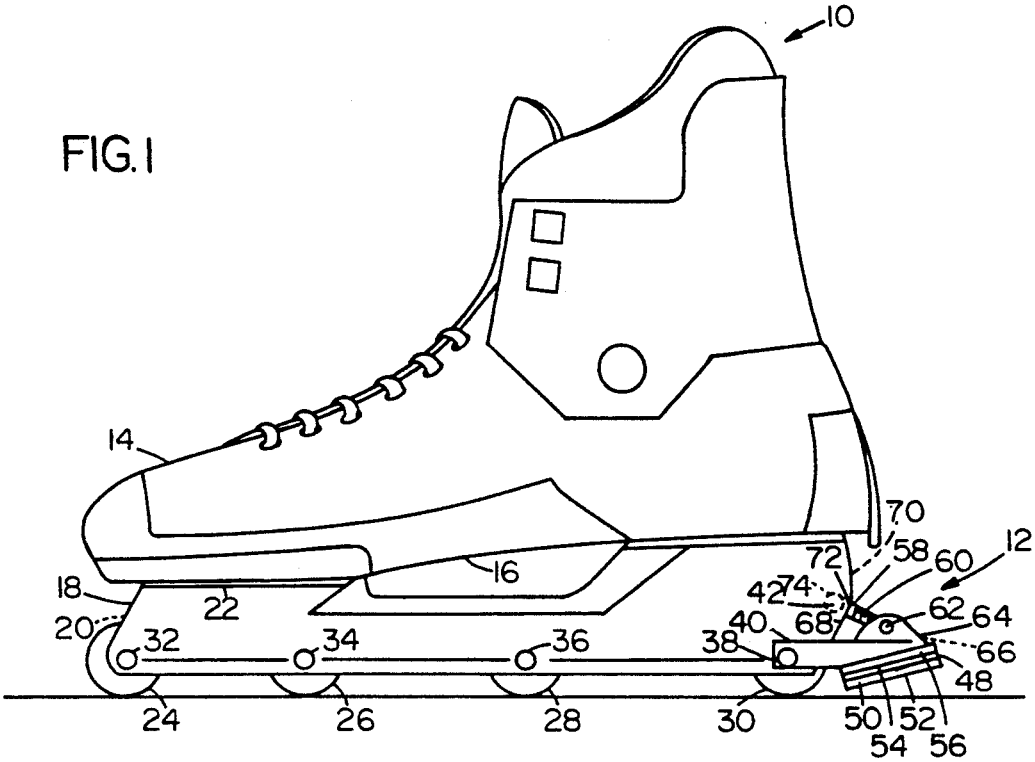
FIG. 1 illustrates a plan view of an in-line skate braking system.

FIG. 1 illustrates a plan view of an in-line skate 10 with an attached braking system 12, the present invention. The in-line skate 10 includes a boot 14 with a boot base 116, and opposing planar members 18 and 20 of FIG. 2, which attach to the base of the boot base 16 through a common connecting member 22 forming a channel. Four rollers 24, 26, 28 and 30 with axle assemblies 32, 34, 36, and 38 secure the rollers between the opposing planar members 18 and 20. Opposing members 40 and 42 connect to a connector member 44, which can be an integral assembly. Holes in the opposing members 40 and 42 secure to the axle assembly 38. The bottom of the connector member 44 is referred to as the brake shoe 46. A resilient, pliable brake pad 48, such as a soft, pliable rubber or other suitable material for frictional engagement with the surface providing an amount of drag producing a braking action, secures to the brake shoe 46 with appropriate screws 50 and 52 through holes in the brake shoe 46. The angle of the braking system 12 can be adjusted about the axle assembly 38. Further adjustment can be affected through an optional adjustment T-bar 58, as now described in detail in this FIG., as well as FIG. 2. The adjustment T-bar 58 includes a threaded shaft 60, which engages through a threaded spacer 62 secured to upward flanges 64 and 66 of the connector member 44 in FIG. 2. Opposing flat portions 68 and 70 engage into a slot 72 in the rear of the common connecting member 22. A round T-bar 74, as illustrated in dashed lines, connects to the flattened portions of the threaded shaft 60. Adjustment of the threaded shaft 60 is by removing the axle assembly 38 to remove the roller 30, dropping the T-bar 74 below the slot, turning the threaded member through the threaded spacer either a finite distance either in or out and then reversing the previous steps as recited to reinstall the T-bar into the slot and then axially securing the rear roller. This then adjusts the angle of the brake shoe 46 with respect to the ground surface and adjustably spaces the brake shoe 46 with respect to the ground surface. In the alternative, a turn buckle may be substituted for the threaded shaft 60 for positional adjustment.

Figure 2:
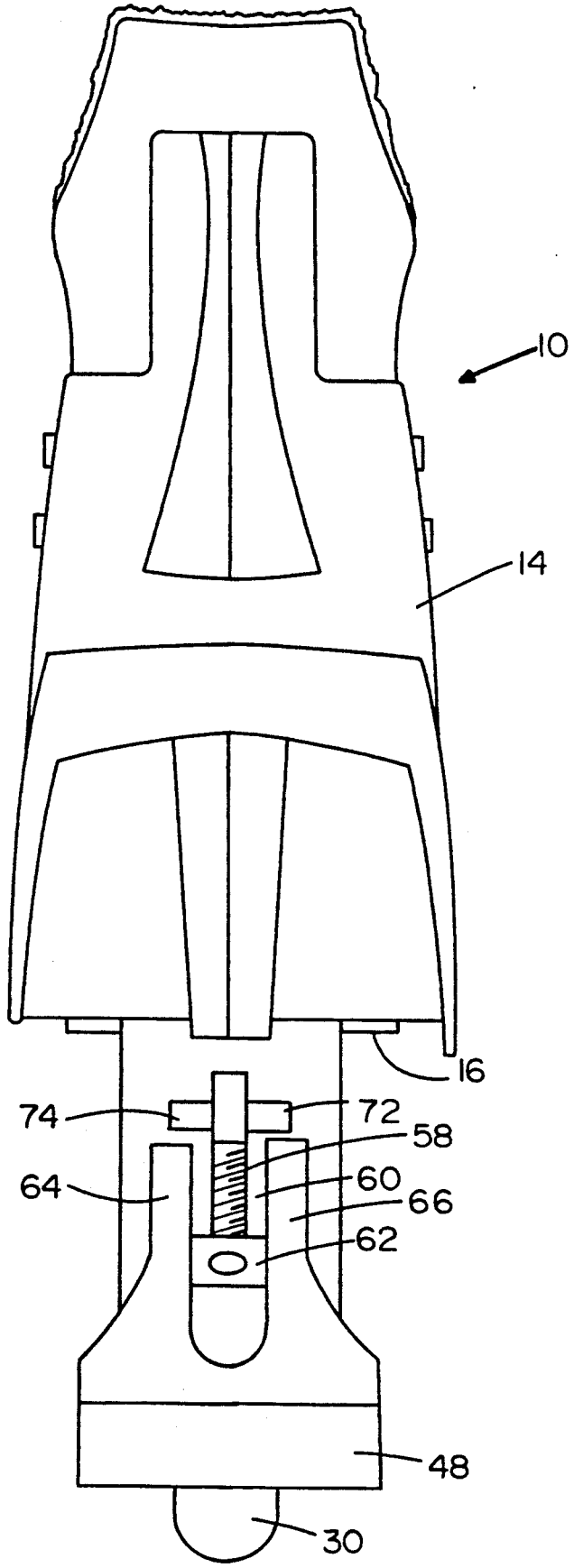
FIG. 2 illustrates a rear view of the present invention.

FIG. 2 illustrates a rear view of the braking system 12, particularly illustrating the threaded shaft 60 where all numerals correspond to those elements previously described.

Figure 3:
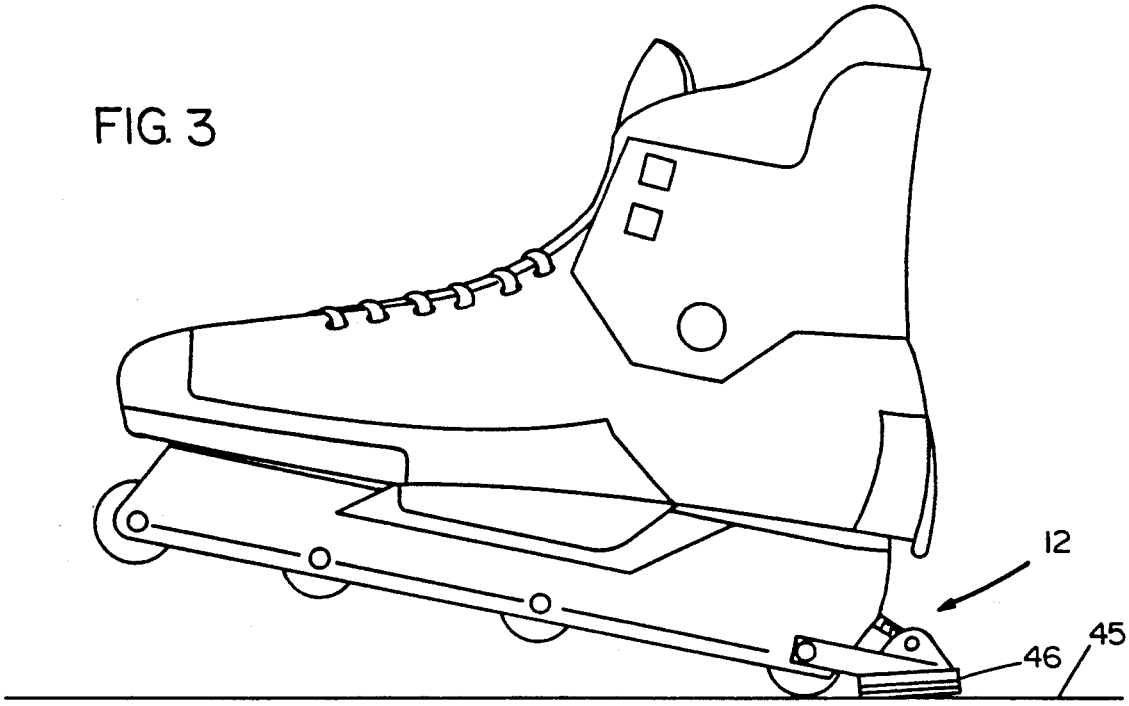
FIG. 3 illustrates the mode of operation of the in-line skate braking system.

FIG. 3 illustrates the brake shoe 46 of the braking system 12 in frictional contact with a flat skating surface 45. All other numerals correspond to those elements previously described.

MODE OF OPERATION

The mode of operation has been described in FIG. 1 for adjusting the angle of the brake shoe with respect to the ground surface. The degree of spacing is determined by one's own preference. The spacing can also be determined by the thickness of the brake pad. The brake pad can also assume any geometrical shape and is not strictly limited to a rectangular planar member. Therefore, an in-line skater may desire to exchange brake pads frequently and often depending upon the surface, the degree of wear, and the degree of desired stopping speed. Some materials will adhere to surfaces more readily than other materials.

DESCRIPTION OF THE FIRST ALTERNATIVE EMBODIMENT

Figure 4:
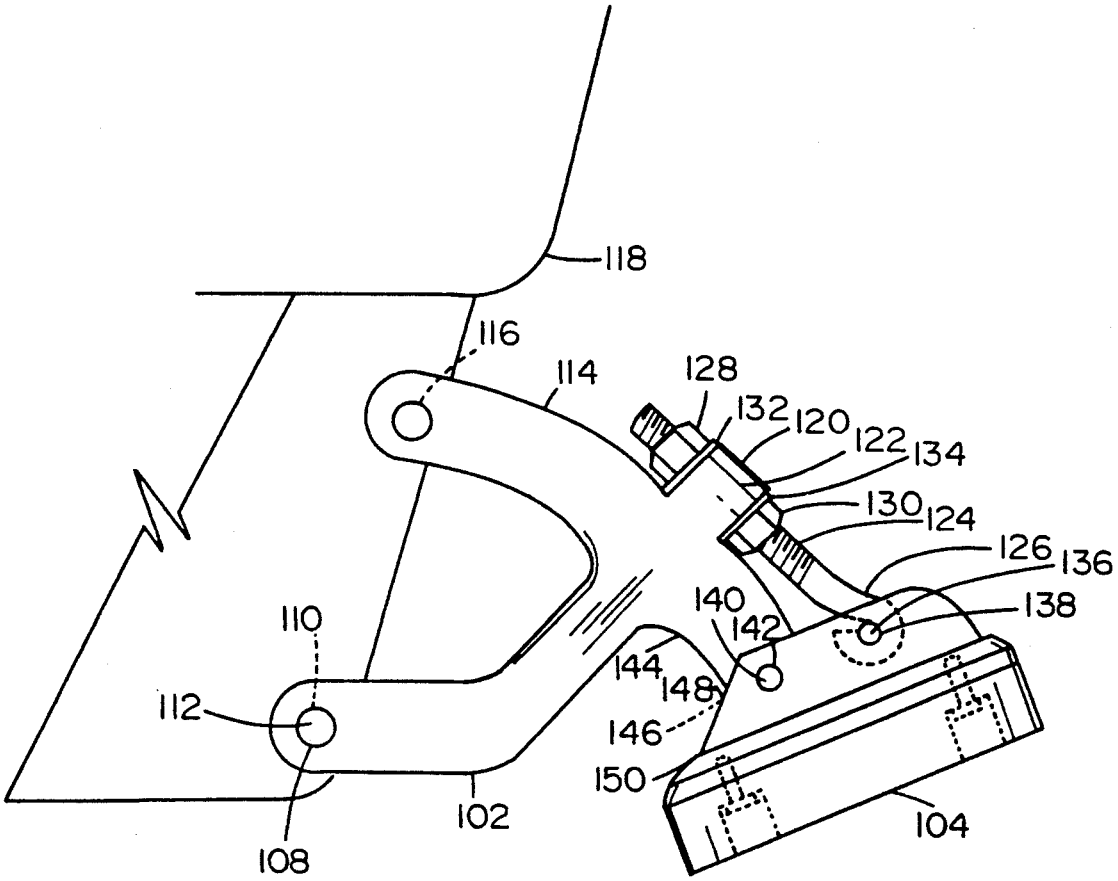
FIG. 4 illustrates a side view of a first alternative embodiment of a non-adjustable brake system for an in-line skate.

FIG. 4, a first alternative embodiment, illustrates a side view of a brake 100 which includes a U-shaped member 102 and a rubber or like material brake pad 104 secured mutually to each other and to the in-line skate 106. Opposing holes 108 and 110 in the U-shaped member 102 align over an axle 112 of the in-line skate 106 to fix and secure the lower half of the brake 100 to the in-line skate 106. An upper support member 114 extends upwardly and forwardly from the U-shaped member 102 and aligns in a geometrically configured socket 116 in the heel 118 of the in-line skate 106. Attached to a mid-portion of the upper support member 114 is machine screw fastener 120 with a hole 122 to receive threaded shaft 124, through which adjustable attachment eye bolt 126 is inserted and secured with nuts 128 and 130. A shaft pin 136 in hole 138 secures the eye bolt 126 and forms a movable pivot point. A pin 140 through hole 142 forms a fixed pivot point about a flange 144. The flange 144 and eye bolt 126 position in a channel 146 formed by upwardly extending members 148 and 150. Screws 152 and 154 through holes 156 and 158 secure the brake pad to the base 160 of the member 102. Attached to the bottom of upper support member 114 is a brake pad 104. The brake pad 104 is connected by means of fixed pivot, which affixes through holes in brake pad 104 and hole in the lower end of upper support member 114, and by movable pivot which connects through an eye of adjustable attachment eye-bolt 126 and opposing holes in the brake pad 104.

Figure 5:
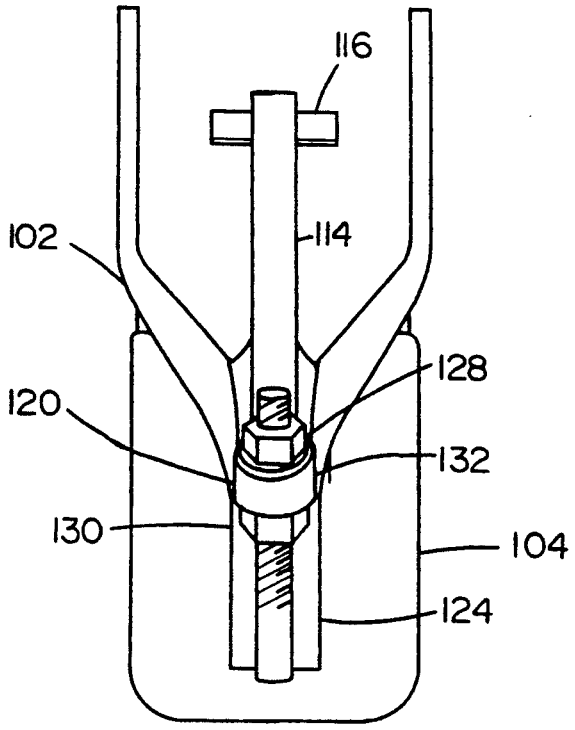
FIG. 5 illustrates a top view of a non-adjustable brake system.

FIG. 5 illustrates a top view of the brake 100 where all numerals correspond to those elements previously described.

Figure 6:
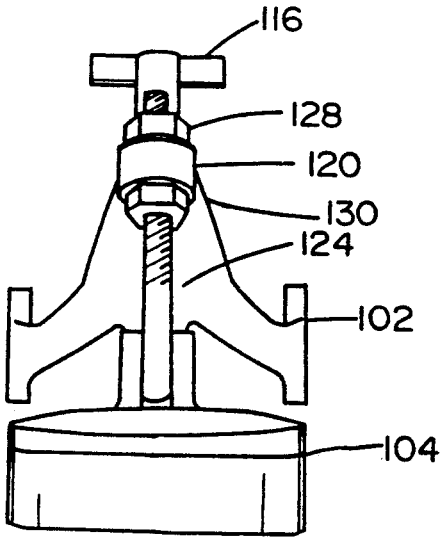
FIG. 6 illustrates an end view of the brake system.

FIG. 6 illustrates a rear view of the brake 100 where all numerals correspond to those elements previously described.

DESCRIPTION OF THE SECOND ALTERNATIVE EMBODIMENT

FIG. 7, a second alternative embodiment, illustrates a brake 200 which includes a geometrically configured U-shaped member 202, also of FIG. 8, and a rubber or like material brake pad 204 secured with screws 206 and 207, as later described in detail, to each other and to the in-line skate. Opposing holes 208 and 210 of FIG. 8 in the U-shaped member 202 align over an axle of the in-line skate to fix and secure the brake 200 to the in-line skate. An adjustable upper support member 214, like that of FIGS. 1-3, extends upwardly and forwardly from the U-shaped member 202 and aligns in the geometrically configured socket below the heel of the in-line skate. The adjustable upper support member 214 includes a plurality of teeth 216 on a member 218 for engaging with teeth 220 of the U-shaped member 202. A bolt 222 engages through an elongated slot 224 of FIG. 8 and into a threaded hole 226. The dual pivot structure provides that maximum rubber can be located close or adjacent to the ground either in a skating mode or in a braking mode.

FIG. 8 illustrates a top view of FIG. 7 where all numerals correspond to those elements previously described. The opposing holes 208 and 210 of the U-shaped member 202 engages over the rear roller of the in-line skate. The round T-bar engages in the heel as previously described in FIGS. 1-3. The bolt 222 provides for securing or movement between the teeth 216 and 220 along the length of the elongated slot 224.

FIG. 9 illustrates an end view of FIG. 7 where all numerals correspond to those elements previously described. The brake pad 204 engages into an enclosed area formed by walls **202*a* and 202*b*. The brake pad 204 extends over the lower edges 226 and 228 at points 230 and 232**.

DESCRIPTION OF THE THIRD ALTERNATIVE EMBODIMENT

Figure 10:
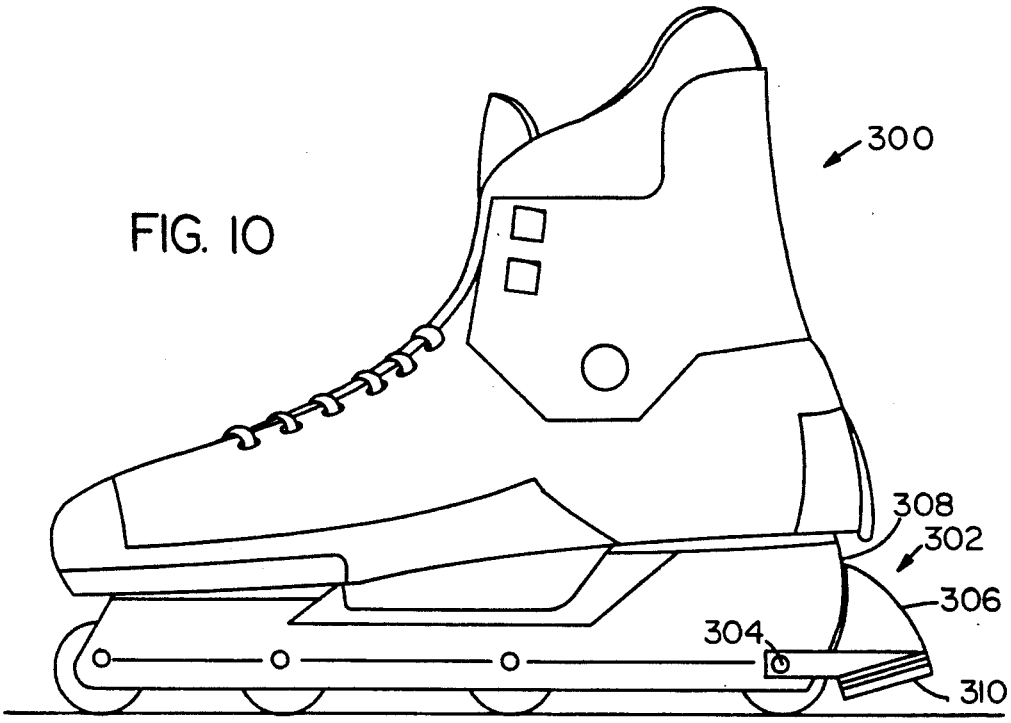
FIG. 10 illustrates a third alternative embodiment of the braking system affixed about the axial assembly.

FIG. 10 illustrates a third alternative embodiment 300 of the braking system 302 affixed about the axial assembly 304. The braking system 302 includes an integral cast member 306 which engages against the rear edges of the opposing planar channel members 308 and 310 in lieu of the adjustable structures of FIGS. 1-3. A brake pad 312 secures with two screws 314 and 316 into holes 318 and 320 into the cast member 306 so that the brake pad is readily interchangeable for either replacement for wear or tear or replacement for other types of braking materials.

The operation of the brake system is similar to that as described in FIGS. 1-3. The motion from the brake pad is transferred up against the opposing planar members by the contact of the edges of the cast member.

DESCRIPTION OF THE FOURTH ALTERNATIVE EMBODIMENT

Figure 11:
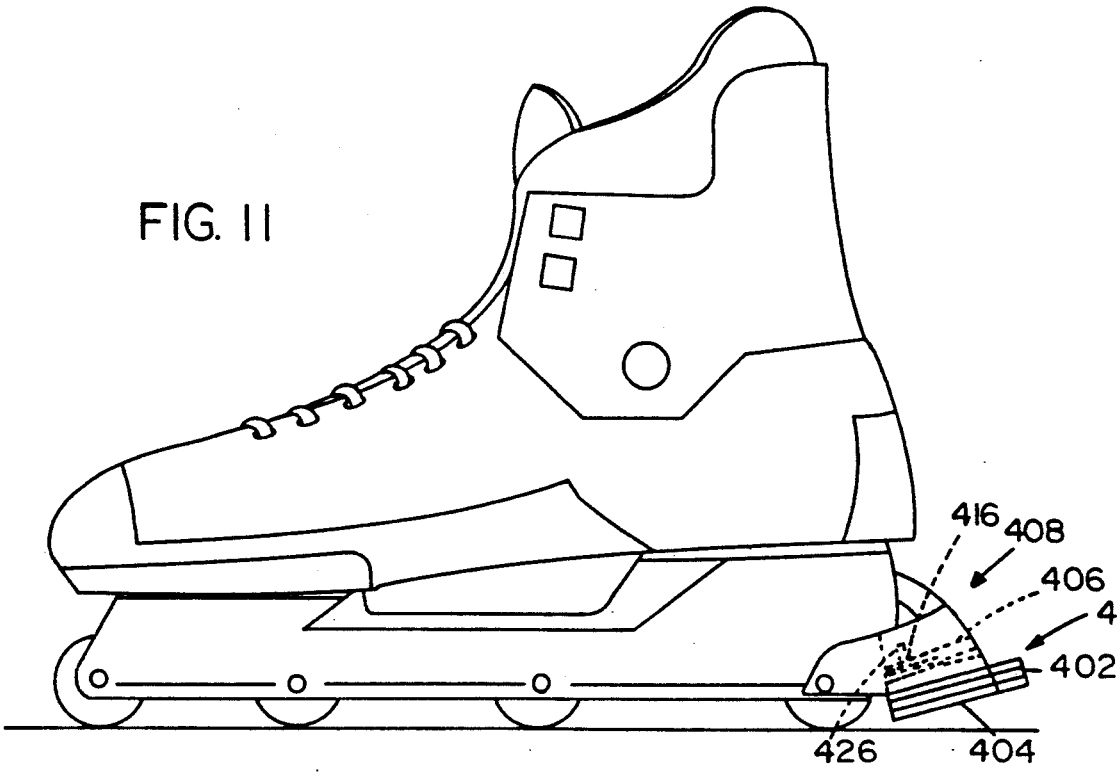
FIG. 11 illustrates a fourth alternative embodiment of an in-line skate brake.

FIG. 11 illustrates a fourth alternative embodiment of a brake 400, including a cast metal brake shoe 402 and a rubber replacement pad 404, as now described in detail with respect to this figure and the remaining figures. The brake 400 slides into opposing grooves 406 of a brake support 408, which engages into and about the rear of the in-line skate. The cast brake shoe 402 includes two opposing edges 410 and 412 which engage into the opposing grooves 406, and a top surface 414 which engages against a bottom surface 416 of the brake support 408. The rear edge 418 mates against the inner surface 420 of the brake support 408. A screw 422 engages through a counter-sunk hole 424 to secure the brake 400 to a screw hole 426 in the brake support 408. A rubber replacement pad 404 secures with two screws 428 and 430 through counter-sunk screw holes 432 and 434 and into holes 436 and 438 of the cast metal brake shoe 402. The replacement rubber material can be any suitable material, and any degree of hardness. In one particular embodiment, it has been found that 3-ply 7/16 inch conveyor belt material, which is reinforced with three layers of webbing is one particular example, by way of example and for purposes of illustration only and not to be construed as limiting of the present invention.

FIG. 12 illustrates an exploded view of the cast metal brake shoe 402 and the rubber replacement pad 404 where all numerals correspond to those elements previously described.

FIG. 13 illustrates a top view of the cast brake shoe 402 where all numerals correspond to those elements previously described.

FIG. 14 illustrates a bottom view of the cast brake shoe 402 where all numerals correspond to those elements previously described.

FIG. 15 illustrates a rear end view of the cast brake shoe 402 where all numerals correspond to those elements previously described.

FIG. 16 illustrates a front end view of the cast brake shoe 402 where all numerals correspond to those elements previously described.

FIG. 17 illustrates a bottom view of the rubber replacement pad 404 where all numerals correspond to those elements previously described.

FIG. 18 illustrates an end view of the rubber replacement pad 404 where all numerals correspond to those elements previously described.

Various modifications can be made to the present invention without departing from the apparent scope hereof. The threaded bolt arrangement of FIGS. 1-3 can be substituted with a turn buckle structure.

I claim:

1. In combination, a cast member and a rubber pad for an in-line skate having a plastic brake support mounted on a rear axle, comprising:

a. a cast metal member including a lower member and an upper geometrically configured member having a top surface at an acute angle to the lower member with at least two raised edges and a rear edge for engaging with the brake support and with a first screw hole for receiving a screw for attaching the member to the brake support, and the lower member have a rear portion extending to the rear of the brake support and having second and third screw holes for receiving two pad screws; and, b. a rubber pad including two pad screw holes for receiving two pad screws for attaching the pad onto said lower member.

2. An in-line skate brake comprising:

a. an in-line skate member for holding multiple in-line wheels;

b. a brake member mounted on a rear wheel and to the skate member;

c. a cast metal member for mounting on the brake member, the cast member having a top member with multiple raised edges and a rear edge for engaging the brake member and a lower member, at an acute angle to the top member, having a portion extending to the rear of the brake support and having a first screw hole for receiving a screw for removable attachment to the brake member and having second and third screw holes for receiving pad screws; and, d. a brake pad having two pad screw holes for receiving the pad screws for attaching the pad to the cast metal member.

* * * * *